US006003680A

United States Patent [19]

Finn

[11] Patent Number: 6,003,680

[45] Date of Patent: Dec. 21, 1999

[54] WASTE SEPARATION DEVICE

[75] Inventor: Larry J. Finn, Gladewater, Tex.

[73] Assignee: Bedminster Bioconversion Corp., Marietta, Ga.

[21] Appl. No.: 08/919,643

[22] Filed: Aug. 28, 1997

Related U.S. Application Data

[60] Provisional application No. 60/027,342, Oct. 1, 1996.

[51] Int. Cl.[6] ..... B07C 5/36

[52] U.S. Cl. ..... 209/616; 209/930; 198/470.1

[58] Field of Search ..... 209/615, 616, 209/930; 198/470.1, 475.1

[56] References Cited

U.S. PATENT DOCUMENTS 4,752,009 6/1988 Dahlby ..... 209/616

5,419,457 5/1995 Ross et al. ..... 209/616

FOREIGN PATENT DOCUMENTS 472242 2/1992 European Pat. Off. ..... 209/616

2232617 12/1990 United Kingdom ..... 209/616

*Primary Examiner*—Tuan N. Nguyen

*Attorney, Agent, or Firm*—Stanley H. Zeyher

[57] ABSTRACT

A waste separation device for removing wrappable materials such as film plastics, rags and rope from a moving stream of solid waste material which device consists of a pole like casing rotatable about it longitudinal axis housing an endless chain drive carrying a plurality of spaced spikes extending from the casing in their movement along the length of the casing in the direction towards the free or discharge end of the casing and retracted within the casing in their movement in the opposite direction.

3 Claims, 5 Drawing Sheets

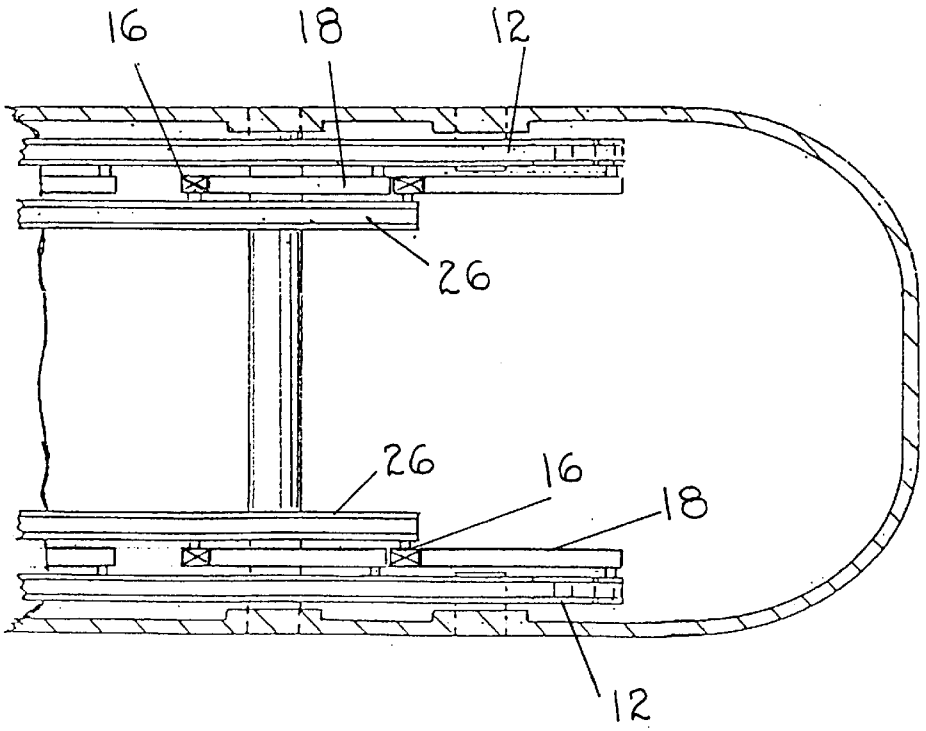
FIG. 5
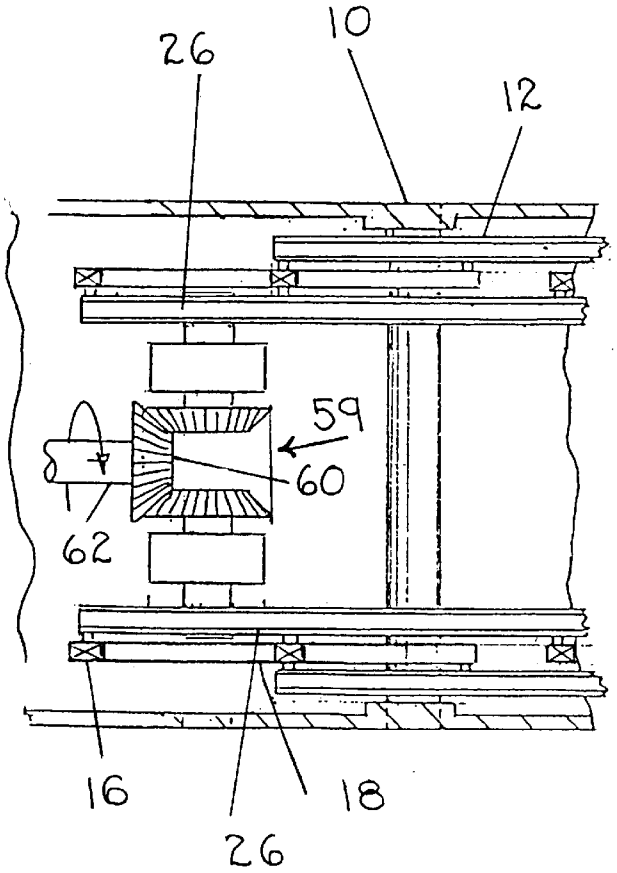

WASTE SEPARATION DEVICE

This invention is based on Provisional Application No. 60/027,342 entitled "Waste Separation Device" filed Oct. 1, 1996 and claims the priority filing date of that application.

BACKGROUND OF THE INVENTION

The invention relates to apparatus for automatically removing from a moving solid waste stream certain fractions and more particularly to apparatus adapted to remove material such as rags, film plastics, rope, etc. which have the physical characteristic of tending to wrap themselves around rotating objects in their path.

While of broader application the invention will be described in connection with its use in removing wrappable material from a moving waste stream prior to its further treatment in a co-composting facility. The removal of this type of material from a solid waste stream has long been a problem particularly in situations in which the waste is to be further treated in a rotating digester. Solid waste streams have increasing amounts of such materials which make recycling and treatment of the waste material more difficult. The present device is designed mechanically and automatically to provide a solution to this problem.

SUMMARY OF THE INVENTION

The apparatus of this invention comprises a rotating pole-like structure or casing provided with one or more pairs of endless moving chains carrying a series of protrusions or spikes. The spikes cause rags and film plastics carried along in a moving waste stream to be ensnared as they wrap around the pole. The poles can be used as single units or multiple poles arranged in a cascading fashion thereby exposing the waste to multiple wrapping actions. Once the material is wrapped on the pole it is progressively moved to the end of the pole by means of the moving spikes. The spikes are attached to moving chains located within the pole. The chains are designed to cause the spikes to move to the end of the pole where they are retracted and to remain retracted during their return to their starting position. This action causes material which is wrapped on the pole to be pushed off the free end of the pole by succeeding spike-driven material. This separates the wrappable stringy material from the waste stream leaving non-wrappable materials such as cardboard, paper, bottles etc. free for further processing.

The apparatus has numerous applications including its use in materials recovery facilities where it is important to separate plastic bags from the recoverable materials. It also finds use in organic and municipal solid waste composting facilities where removal of plastic bags and other wrappable materials is important. In certain instances it is critical in maintaining operation through removal of such material such as in a composting facility where a phenomenon known as balling can shut down operations.

BRIEF DESCRIPTION OF THE DRAWINGS

The invention will be better understood by reference to the following detailed description taken in connection with the appended drawings, in which:

FIG. 5 is a sectional side elevation showing details of the chain drive systems.

DESCRIPTION OF THE PREFERRED EMBODIMENT

Figure 1:
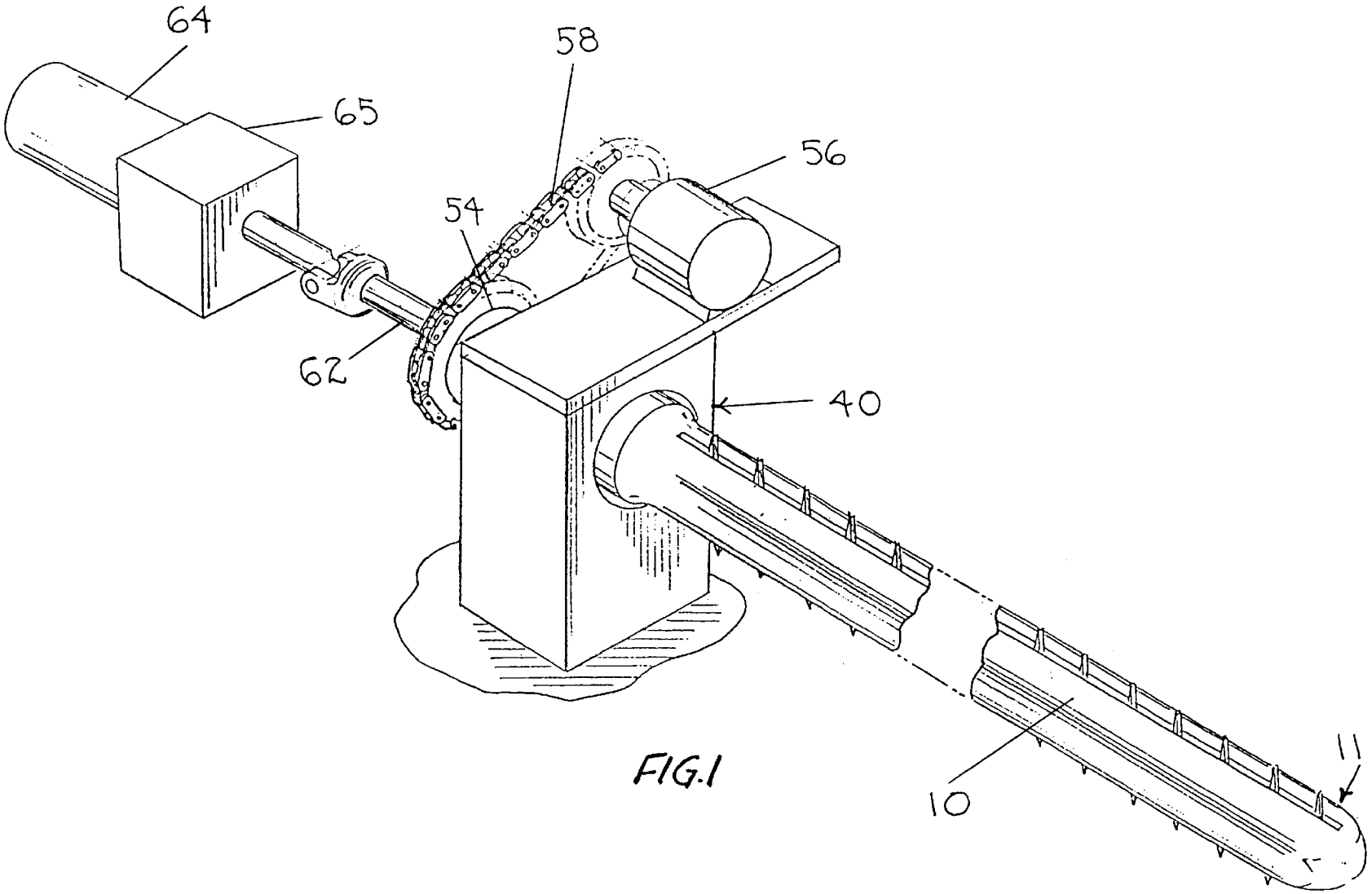
FIG. 1 is a perspective of a pole-like wrapping unit comprising a presently preferred embodiment of a device for separating from a moving waste stream materials which tend to wrap themselves about a rotating object.

Referring now to the drawings, and to FIG. 1 in particular, there is shown a presently preferred form of wrapping device for separating out of a moving stream of solid waste materials, rags, film plastics, rope and other similar type of materials which tend to wrap themselves about a rotating object. The wrapper pole or casing 10, shown in FIG. 1 contains two pairs of spike-carrying chains. The pole is designed to rotate about its longitudinal axis as the chains traverse the length of the pole. Any material which is inclined to wrap itself around a rotating object is ensnared on the spikes and carried by the moving spikes toward the discharge end 11 of the pole. As the spikes reach the end of the pole they are retracted within the steel shell 10 encasing the unit. This action causes any material impaled on the spikes to be ejected off the end of the pole. The spikes remain retracted within the shell casing on their return to their starting position where the spikes are unsheathed to repeat the process.

Figure 2:
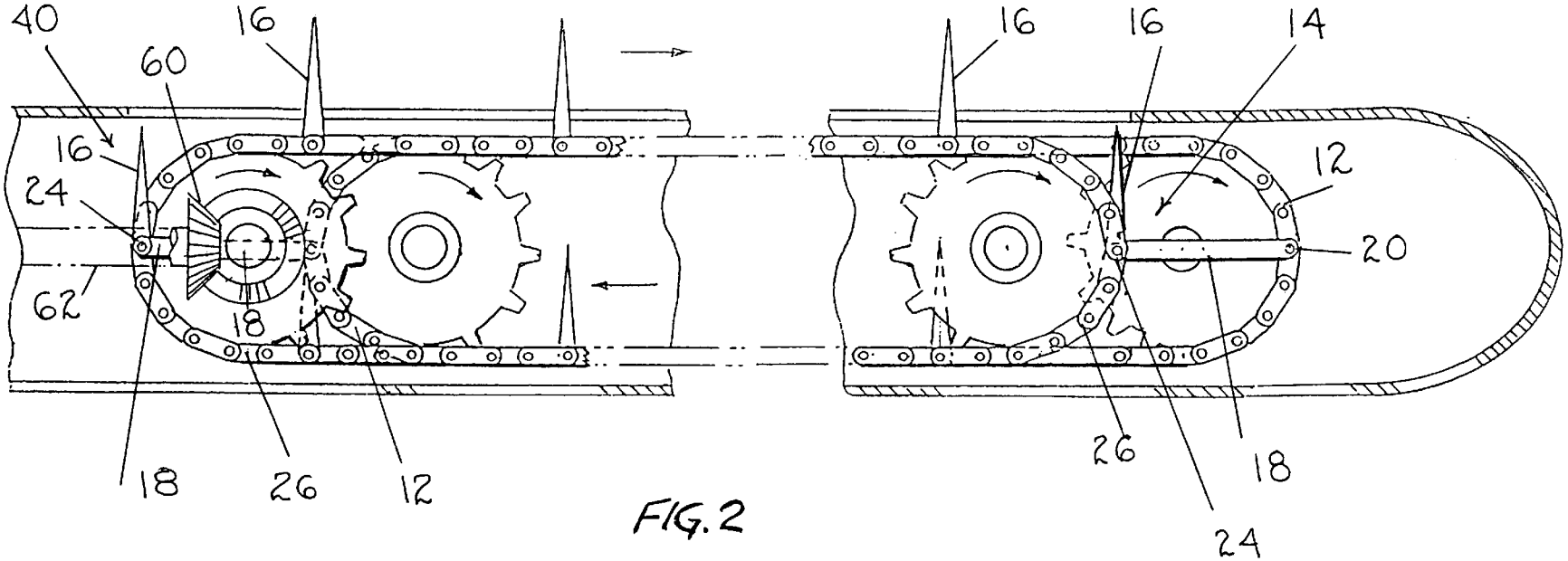
FIG. 2 is a cut-away side elevational view showing constructional details of the chain drive system.

The mechanisms for achieving the above described operation can best be understood by reference to FIGS. 2–5. FIG. 2 is a side view of a pair of operating chains 12 and 26. As seen in that figure and in FIG. 3 the chains are of equal length and are offset from each other along there length and are in spaced side-by-side relation as can best be seen by reference to FIGS. 4 and 5. Each chain is provided along its length with a series of spaced spike-like assemblies 14 comprising a spike element 16 having a nominal, exposed length outside the casing or shell of from four to six inches. Each spike assembly is of generally L-shaped configuration as can best be seen in FIG. 2. The non-spike element 18 of the assembly is pivotally secured at its outer end 20 to the most forwardly presented section of chain 12. The trailing end 24 of the link is pivotally secured to the rearwardly presented chain 26. The spaced relation of drive sprockets 30 and 32 and idler sprockets 34 and 36 supported on sprocket bearings 38 can be seen in FIG. 4. By this arrangement, as the spikes reach the end of their travel along the pole they are withdrawn into the casing shell 10 and remain withdrawn until they reach their most rearward position 40 at which point the spikes re-emerge from the shell to repeat their traverse of the pole. At the rearmost location 40, as viewed from left to right in FIG. 2 the end 24 of link 18 is carried by the most rearwardly presented chain 26 and the trailing end of link 18 is pivotally secured to chain 12.

Figure 3:
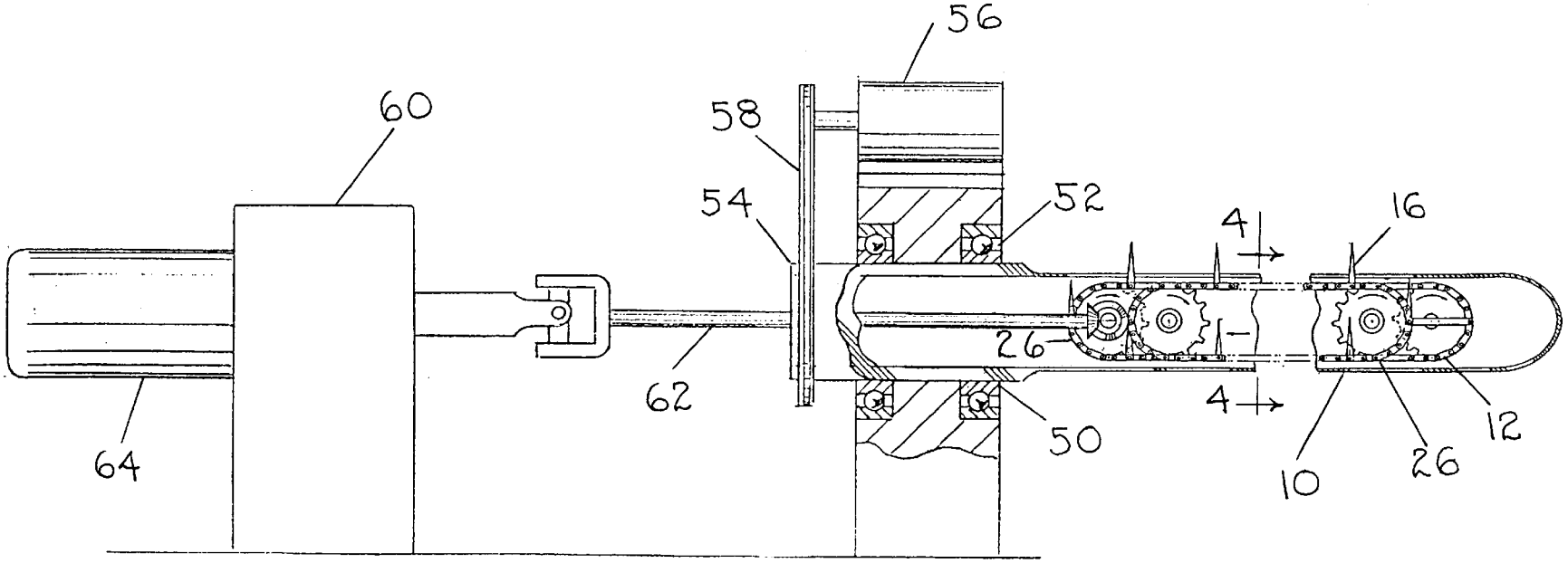
FIG. 3 is a cut-away sectional view of FIG. 1 depicting details of the support and rotational and translational drive systems for the device.
Figure 4:
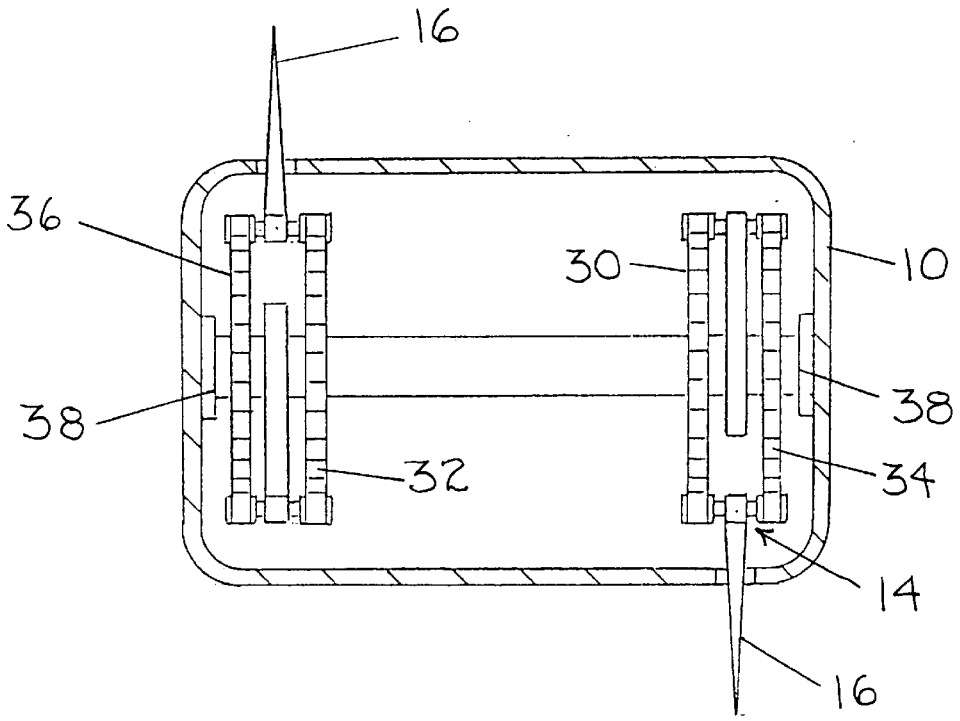
FIG. 4 is a sectional view taken along the cutting plane 4—4 of the drive systems shown in FIG. 3.
Figure 6:
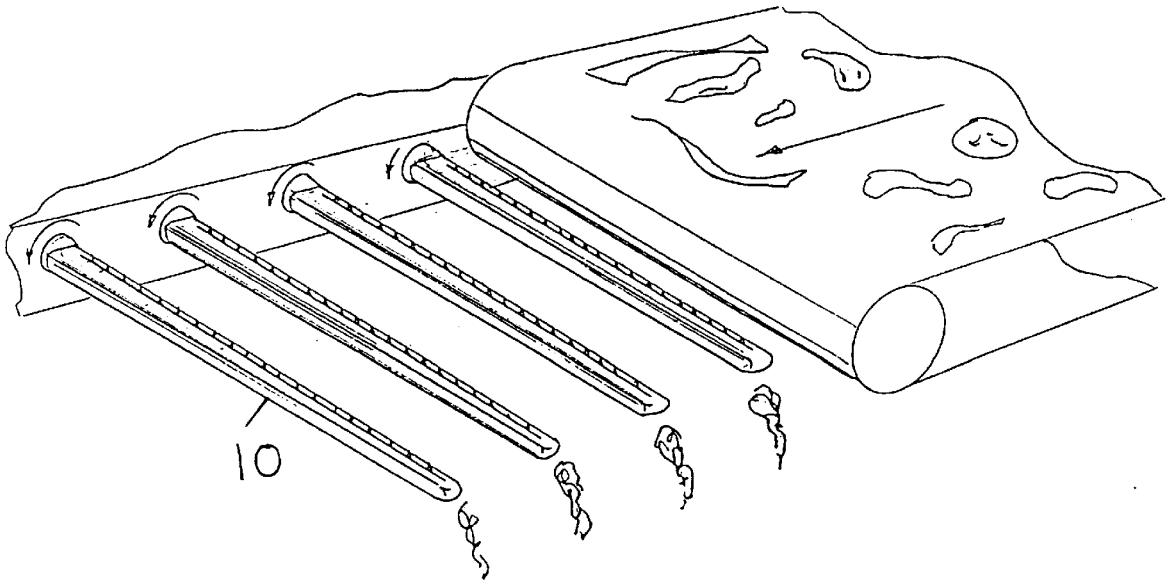
FIG. 6 is a schematic showing depicting one arrangement for separating wrappable material from a moving waste stream through use of a cascading array of waste separation devices.

As seen in FIG. 3 the steel casing comprising pole 10 is supported within fixed ring 50 on roller bearings 52. The pole is rotated through sprocket 54 which is fixedly secured to the casing and driven by variable speed motor 56 connected to the sprocket by chain drive 58. As seen in FIG. 5. the chain drive is through a common bevel gear box 59 connected to the chains by bevel gear 60 carried on drive shaft 62. The drive shaft is operated through gear box 65 powered by a variable speed motor 64.

Having described the presently preferred embodiment of the invention with reference to the appended drawings, it should be understood by those skilled in the art that various changes in construction can be introduced without departing from the true teaching of the invention as defined in the appended claims.

I claim:

1. A device for removing wrappable materials from a moving stream of solid waste material comprising a pole-like casing rotatable about it longitudinal axis housing one or more endless chain drives each carrying a plurality of spaced, spike-like elements; drive means for moving the chains to cause said spikes to traverse along the length of the casing in a manner extending from the casing in there movement towards one end of the casing and to be retracted within the casing in there movement towards the opposite end of the casing.

2. The device set forth in claim 1 wherein said casing houses at least two synchronously driven, endless chain drives of equal length, longitudinally and transversely offset from one another carrying a series of spaced L-shaped assemblies, in which said spike-like element forms the upright arm of said assembly and the horizontal arm of which pivotally interconnects said spike-like element with said chain drives such that said spike-like element in its back and forth traverse of the casing remains in a fixed orientation.

3. Apparatus for removing wrappable material from a moving stream of waste material comprising: a pole-like casing housing one or more pairs of endless chains carrying a series of spaced, spike-like elements; drive means for moving the chains to cause said elements to traverse along the length of the pole; openings provided in the casing to permit said elements to project beyond the surface of the casing during their movement in one direction and to withdraw beneath the surface of the casing in their movement in an opposite direction; said chains being offset from each other both along their length and in their side-by-side relationship and means pivotally interconnecting each of said spike elements to said chains such that said spike elements remain in an upright position during their traverse in both directions along the pole; and means for rotating the pole whereby wrappable material impinging on the pole, is caused to wrap around the pole and to be carried along the pole by the spikes for discharge at one end of the pole as said elements withdraw within the casing.

* * * * *